US005885942A

United States Patent [19]

Zhang et al.

[11] Patent Number: 5,885,942

[45] **Date of Patent: *Mar. 23, 1999**

[54] MULTIFUNCTIONAL LUBRICANT ADDITIVE

[75] Inventors: Ruiming Zhang, Coppell; Robert M. Hooks, Fort Worth, both of Tex.

[73] Assignee: NCH Corporation, Irving, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 935,394

[22] Filed: Sep. 23, 1997

[51] Int. Cl.[6] ..... C10M 141/12

[52] U.S. Cl. ..... 508/184; 508/273; 508/274; 508/282; 508/374; 508/474; 508/487; 252/75; 252/76; 252/78.1

[58] Field of Search ..... 508/184, 273, 508/274, 282, 289, 374, 464, 474, 487; 252/75, 76, 78.1

[56] References Cited

U.S. PATENT DOCUMENTS

| | | | |
|---|---|---|---|
| 3,923,669 | 12/1975 | Newingham et al. | 508/273 |
| 4,022,700 | 5/1977 | Harris | 508/184 |
| 4,049,393 | 9/1977 | Orelup | 508/184 |
| 4,105,571 | 8/1978 | Shaub et al. | 508/435 |
| 4,609,480 | 9/1986 | Hata et al. | 508/273 |
| 4,683,069 | 7/1987 | Brewster et al. . | |
| 4,871,465 | 10/1989 | Hutchison | 508/273 |
| 4,880,551 | 11/1989 | Doe . | |
| 5,094,763 | 3/1992 | Tochigi et al. | 508/273 |
| 5,152,926 | 10/1992 | Brown | 508/274 |
| 5,422,023 | 6/1995 | Francisco | 508/273 |
| 5,516,440 | 5/1996 | Dasai et al. | 508/274 |
| 5,622,922 | 4/1997 | Clarke et al. | 508/274 |

FOREIGN PATENT DOCUMENTS

| | | |
|---|---|---|
| 0045827 | 2/1982 | European Pat. Off. . |
| 0593263A1 | 4/1994 | European Pat. Off. . |
| 0761805A2 | 3/1997 | European Pat. Off. . |

OTHER PUBLICATIONS

Product Brochure for Slick 50, issued by Slick 50 Products Corp. undated.

Product Information for Militec–1 by Militec, Inc., Washington, D.C. and Norfolk, VA. undated.

*Primary Examiner*—Margaret Medley

*Attorney, Agent, or Firm*—Locke Purnell Rain Harrell, P.C.; Monty L. Ross

[57] ABSTRACT

The multifunctional lubricant additive compositions of the invention preferably contain a methylene bis (dibutyldithiocarbamate) as an antiwear and extreme pressure additive, a 2,5-dimercapto-1,3,4-thiadiazole derivative as an antioxidant and antiwear additive, a tolutriazole compound as an antioxidant and corrosion inhibitor, a glycerol monooleate as a friction modifier, a calcium sulfonate as a detergent and extreme pressure additive, a zinc dialkyl dithiophosphate as an antiwear and antioxidant additive, a polymethylacrylate as a dispersant, a polyol ester as a carrier and friction modifier, a red dye for leak detection, and optionally, solvent neutral oil and a pour point depressant.

26 Claims, No Drawings

MULTIFUNCTIONAL LUBRICANT ADDITIVE

BACKGROUND OF THE INVENTION

1. Field of the Invention

This invention relates to additive packages for lubricants, and more particularly, to a multifunctional additive useful for improving the properties of petroleum and synthetic hydrocarbon based engine oils, gear oils, hydraulic oils, compressor oils, and most soap-based greases.

2. Description of Related Art

The trend in modern machinery design is toward compactness and energy efficiency, which means metal parts reduced in size but more complex, while providing the same or increased power, or carrying the same or a higher load. These design parameters in turn create a need for better lubricants. As used herein, the term "lubricants" refers to both oils and greases. Effective lubricants desirably reduce friction, with associated reductions in noise, wear, maintenance and failure-related shutdowns.

It is well known that not all lubricants available in the marketplace are high performance products. Many users purchase less expensive, general purpose lubricants without regard to the need for lubricants having specialized properties for use in applications involving extreme pressure, high wear, or other adverse conditions. It is also well known that many aftermarket additives are available for improving the properties of various lubricants. The lubricant industry is under increasing pressure to develop new base oil and additive technologies that offer higher performance, extended service life and environmental compatability. Some of the conventional, commercially available lubricant additives contain solid materials or chlorinated petroleum products. Solid particles, even polytetrafluoroethylene, can settle out of the lubricant, clog filters, and cause plugging, caking or other undesirable buildup. Clorinated products are typically corrosive, and can cause undesirable pitting in metal surfaces as well as increasing associated disposal costs.

For all of the foregoing reasons, a multifunctional lubricant additive is needed that has excellent lubricating, extreme pressure and antiwear properties, that contains no solids or halogenated compounds, and that will extend the service life of the treated oil or grease.

SUMMARY OF THE INVENTION

The multifunctional lubricant additive compositions of the invention preferably contain a methylene bis (dibutyldithiocarbamate) as an antiwear and extreme pressure additive, a 2,5-dimercapto-1,3,4-thiadiazole derivative as an antioxidant and antiwear additive, a tolutriazole compound as an antioxidant and corrosion inhibitor, a glycerol monooleate as a friction modifier, a calcium sulfonate as a detergent and extreme pressure additive, a zinc alkyldithiophosphate as an antiwear and antioxidant additive, an acrylic copolymer as a dispersant, a polyol ester as a carrier and friction modifier, a red dye for leak detection, and optionally, solvent neutral oil and a pour point depressant.

According to one preferred embodiment of the invention, a multifunctional lubricant additive is provided that comprises from about 2 to about 16 weight percent methylene bis(dibutyidithiocarbamate) as an antiwear and extreme pressure additive, from about 2 to about 16 weight percent 2,5-dimercapto-1,3,4-thiadiazole derivative as an antioxidant and antiwear additive, from about 2 to about 16 weight percent of a tolutriazole compound in a diluent oil or a polyol ester solvent as an antioxidant and corrosion inhibitor, from about 2 to about 16 weight percent glycerol monooleate as a friction modifier, from about 2 to about 16 weight percent zinc alkyldithiophosphate as an antiwear and antioxidant additive, from about 0.4 to about 3.2 weight percent calcium sulfonate as a detergent and extreme pressure additive, from about 0.25 to about 3 weight percent poly(alkyl methacrylate) as a dispersant, from about 20 to about 60 weight percent polyol ester as a carrier and friction modifier, up to about 0.02 weight percent red dye for leak detection, up to about 50 weight percent solvent neutral oil, and up to about 0.6 weight percent alkyl ester copolymer as a pour point depressant.

Lubricating oils are desirably treated with the additive of the invention at a treat rate of one part by weight additive to from about 15 to about 31 parts by weight oil. Greases are desirably treated with the additive of the invention at a treat rate of one part by weight additive to from about 7 to about 15 parts by weight grease. A particularly preferred treat rate is about 6.25 weight percent additive by weight of the treated lubricant.

DESCRIPTION OF THE PREFERRED EMBODIMENTS

The composition of the invention is a multifunctional lubricant additive that is believed useful for improving the physical properties, performance and service life of lubricants including, for example, petroleum and synthetic hydrocarbon based oils and greases. Such lubricants include without limitation engine oils, gear oils, hydraulic oils, compressor oils and soapbased greases.

The lubricant additive of the invention preferably comprises from about 20 to about 60 weight percent of a polyol ester carrier. A preferred polyol ester suitable for use in the invention is a mixture of pentaerythritol tetraesters and dipentaerythritol hexaesters of $C_5$–$C_9$ fatty acids marketed under the trademark Hatcol 2954 by Hatco Corporation of Fords, N.J. This polyol ester has a viscosity (ASTM D-445) ranging from about 4.8 to about 5.2 cSt at 100° C.; a flash point (ASTM D-92) of at least 249° C., C.O.C.; a pour point (ASTM D-97) of −54° C. or lower; a Total Acid Number (ASTM D-664) of 0.05 mgKOH/g or lower; and a water content (ASTM D-1533, Method B) of 0.05 wt. % or lower.

The multifunctional lubricant additive of the invention preferably further comprises from about two to about 16 weight percent each of: Methylene bis (dibutyldithiocarbamate), which is believed to function as an antiwear and extreme pressure additive; a 2,5-dimercapto-1,3,4-thiadiazole derivative, which is believed to function as an antioxidant and antiwear additive; a tolutriazole compound, which is believed to function as an antioxidant synergist; glycerol monooleate, which is believed to function as a friction modifier; and zinc alkyldithiophosphate, which is believed to function as an oxidation inhibitor and antiwear agent.

A preferred methylene bis(di-n-butyldithiocarbamate) suitable for use in the invention is marketed under the trademark Vanlube 7723 by R.T. Vanderbilt Company, Inc. of Norwalk, Conn. Vaniube 7723 is a dark amber liquid having a density of 1.054 $Mg/m^3$, a flash point of 177° C. C.O.C., and a viscosity of 14.5 cSt at 100° C.

A preferred 2,5-dimercapto-1,3,4-thiadiazole derivative, reportedly comprising alkyl polycarboxylates, suitable for use in the invention is marketed under the trademark Vanlube 871 by R.T. Vanderbilt Company, Inc. of Norwalk, Conn. Vaniube 871 is an amber liquid having a density of 1.11 $Mg/m^3$, a flash point of 210° C. C.O.C., and a viscosity of 21.45 cSt at 100° C.

A preferred tolutriazole compound suitable for use in the additive of the invention when intended for use with petroleum based lubricants is 1-[di(4-octylphenyl)aminomethyl] tolutriazole, a proprietary product marketed under the trademark Vanlube 887 by R.T. Vanderbilt Company, Inc. of Norwalk, Conn. Vanlube 887 is a dark amber liquid having a density of 0.963 $Mg/m^3$, a flash point of 182.2° C. C.O.C., and a viscosity of 17.76 cSt at 100° C. Vaniube 887 comprises about 50 weight percent of the active ingredient in a diluent oil, and is reported to be ashless and nitrogen containing. A preferred tolutriazole compound suitable for use in the additive of the invention when intended for use in synthetic lubricants is a proprietary product marketed under the trademark Vanlube 887E by R.T. Vanderbilt Company, Inc. of Norwalk, Conn. Vanlube 887E is a clear, amber to orange liquid having a density of 1.01 $Mg/m^3$, a minimum flash point of 225° C. C.O.C., and a viscosity of 21.0 cSt at 100° C. Vanlube 887E comprises about 50 weight percent of the active ingredient in a polyol ester solvent.

A preferred glycerol monooleate suitable for use in the invention is marketed under the trademark EMERY® 2421 by Henkel Corporation, Cincinnati, Ohio. This glycerol monooleate has a viscosity (ASTM D-445) of about 10.0 cSt at 100° C.; a flash point (ASTM D-92) of about 242° C., C.O.C.; a pour point (ASTM D-97) of about 18° C.; and a density of about 948 g/l at 15.6° C.

A preferred zinc alkyldithiophosphate suitable for use in the invention is marketed under the trademark Lubrizol® 1395 by The Lubrizol Corporation, Wickliffe, Ohio. This zinc alkyldithiophosphate has a viscosity of about 13.5 cSt at 100° C.; a flash point of about 91° C. (PMCC); a specific gravity of about 1.18 at 15.6° C. Lubrizol® 1395 is reportedly a zinc $C_1$–$C_{14}$ alkyldithiophosphate containing from about 9.3 to about 9.7 weight percent phosphorus, from about 19.0 to about 21.0 weight percent sulfur, and from about 10.0 to about 11.2 weight percent zinc.

The lubricant additive of the invention preferably further comprises from about 0.4 to about 3.2 weight percent calcium sulfonate, which is believed to function as a detergent and extreme pressure additive. A preferred calcium sulfonate mixture suitable for use in the invention is marketed under the trademark Lubrizol® 78 by The Lubrizol Corporation, Wickliffe, Ohio. Lubrizol® 78 has a viscosity of about 60 cSt at 100° C.; a flash point of about 156° C. (PMCC); a specific gravity of about 1.22 at 15.6° C. Lubrizol® 78 reportedly contains from about 15.0 to about 16.0 weight percent calcium and from about 1.25 to about 1.80 weight percent sulfur.

The lubricant additive of the invention preferably further comprises from about 0.25 to about 3 weight percent acrylic copolymer, most preferably a poly(alkyl methacrylate), which is believed to function as a dispersant. A preferred acrylic copolymer suitable for use in the invention is marketed under the trademark ACRYLOID® 954 by Rohm and Haas Company, Philadelphia, Pa. This poly(alkyl methacrylate) has a specific gravity of 25 0.906 at 15.5° C.; a viscosity (ASTM D-445) ranging from about 1100 to about 1500 cSt at 100° C.; a flash point (ASTM D-92) of about 190° C., C.O.C.; a pour point (ASTM D-97) of −4° C. or lower; and a Neutralization Number (ASTM D-974) of 0.4.

The lubricant additive of the invention preferably further comprises up to about 0.02 weight percent of a disazo dye, which desirably functions as an identifier and leak detector. A preferred disazo dye for use in the invention is an oil red dye marketed under the tradename Oil Red B Liquid by Octel America, Inc., Newark, Del.

The lubricant additive of the invention, when intended for use in petroleum hydrocarbon based systems, preferably further comprises up to about 50 weight percent of a solvent neutral oil, most preferably a solvent-extracted neutral oil (low-pour) having a viscosity of about 4.02 cSt at 100° C. (105 SSU at 100° F.). Such an oil is marketed, for example, under the tradename 100 L.P. Solvent Neutral by Exxon Chemical, Houston, Tex.

The lubricant additive of the invention preferably further comprises from 0 to about 0.60 weight percent of a pour point depressant. A preferred pour point depressant suitable for use in the invention is an alkyl ester copolymer marketed under the trademark Lubrizol® 6662 by The Lubrizol Corporation, Wickliffe, Ohio. Lubrizol® 6662 has a viscosity of about 425 cSt at 100° C.; a specific gravity of about 0.9 at 15.6° C.; and reportedly contains from about 0.13 to about 0.4 weight percent nitrogen.

The method of making the lubricant additive compositions of the invention is further described and explained in relation to the following examples:

EXAMPLE 1

A one thousand gallon batch of a preferred lubricant additive of the invention is made as follows:

After introducing about 1760.86 kg (3882 lbs) 100 solvent neutral oil (SNO) into a stirred tank and thereafter adding about 876.71 kg (1932.8 lbs) Hatcol 2954 and 140.87 kg (310.56 lbs) Emery 2421, the resultant composition is heated to a temperature ranging from about 43.3 to 48.9° C. (110 to 120° F.) and mixed for about one hour. About 28.17 kg (62.11 lbs) Lubrizol 78, about 140.87 kg (310.56 lbs) Vanlube 887, about 140.87 kg (310.56 lbs) Vanlube 871, about 140.87 kg (310.56 lbs) Vanlube 7723, about 140.87 kg (310.56 lbs) Lubrizol 1395, about 10.57 kg (23.3 lbs) Lubrizol 6662, about 17.36 kg (38.28 lbs) Acryloid 954 and about 0.177 kg (0.39 lbs) Oil Red B are then added and the resultant composition is mixed for about two additional hours while maintaining the temperature within the same range. The heat is then turned off and the resultant additive is withdrawn and permitted to cool.

EXAMPLE 2

A one thousand gallon batch of another preferred lubricant additive of the invention is made as follows:

About 1134 kg (2500 lbs) Hatcol 2954, about 305.68 kg (673.9 lbs) Lubrizol 1395, about 305.68 kg (673.9 lbs) Vanlube 7723, about 305.68 kg (673.9 lbs) Vanlube 877E, about 305.68 kg (673.9 lbs) Vanlube 871, about 305.68 kg (673.9 lbs) Emery 2421, about 61.145 kg (134.8 lbs) Lubrizol 78, about 57.335 kg (126.4 lbs) Acryloid 954, and about 0.191 kg (0.421 lbs) Oil Red B are introduced into a stirred tank, and the resultant composition is heated to a temperature ranging from about 43.3° to 48.9° C. (110° to 120° F.) and mixed for about one hour. About 1040 kg (2292.8 lbs) Hatcol 2954 are then added and the resultant composition is mixed for about one additional hour while maintaining the temperature within the same range. The heat is then turned off and the resultant additive is withdrawn and permitted to cool.

Liquid lubricants exhibiting the beneficial effects of the additives disclosed herein are preferably made by dispersing therein sufficient additive as herein described to produce an additive to lubricant ratio ranging from about 1:15 to about 1:31 by weight. The preferred rate for treating soap-based greases with the lubricant additive of the invention desirably ranges from about 1:7 to about 1:15 additive to lubricant by weight.

Data exhibiting the performance of the subject compositions in comparison to other commercially available lubricant additives are illustrated in the following Table:

Table of Comparison of MLA[1)] with Additive A[2)] and Additive B[3)] In 600 SNO[4)] (base oil), Strata XL[5)] (diesel oil) and 10W-30[6)] (motor oil)

| TESTS | OILS | Without | With Additive A Treat Ratio 1:15 | With Additive B Treat Ratio 1:15 | With MLA-I Treat Ratio 1:15 | With MLA-II Treat Ratio 1:15 |
|---|---|---|---|---|---|---|
| 4-Ball Wear[7)] | 600 SNO | 0.720 mm | 0.370 mm | 0.432 mm | 0.364 mm | 0.345 mm |
| | Strata XL | 0.379 mm | 0.288 mm | — | 0.364 mm | 0.347 mm |
| | 10W-30 | 0.410 mm | 0.391 mm | 0.379 mm | 0.372 mm | 0.357 mm |
| FLC Lubricity[8)] | 600 SNO | 25 ftlb | 90 ftlb | — | 95 ftlb | 100 ftlb |
| | | 5 × 10 mm | 2 × 4 mm | — | 2 × 3 mm | 4 × 8 mm |
| | Strata XL | 50 ftlb | 110 ftlb | — | 95 ftlb | 100 ftlb |
| | | 4 × 7 mm | 4 × 7 | — | 2 × 3 mm | 2 × 3 mm |
| | 10W-30 | 40 ftlb | 150 ftlb | 40 ftlb | 77 ftlb | 100 ftlb |
| | | 3 × 5 mm | 3 × 4 mm | 3 × 6 mm | 2 × 3 mm | 2 × 3 mm |
| Cu Corrosion[9)] | 600 SNO | 1a | 1a | — | 1a | 1a |
| | Strata XL | 1b | 1b | — | 1b | 1b |
| | 10W-30 | 1a | 3a | 1a | 1a | 1a |
| Fe Corrosion[10)] | 600 SNO | 1 | 1 | — | 1 | 1 |
| | Strata XL | 1 | 2 | — | 1 | 2 |
| | 10W-30 | 1 | 1 | 1 | 1 | 1 |
| COF[11)] | 600 SNO | 0.514 | 0.150 | — | 0.100 | 0.100 |
| | Strata XL | 0.100 | 0.116 | — | 0.122 | 0.119 |
| | 10W-30 | 0.104 | 0.108 | 0.113 | 0.110 | 0.098 |
| Timken EP[12)] | 600 SNO | 25 lb | — | — | 45 lb | 50 lb |
| | Strata XL | 50 lb | 50 lb | — | 50 lb | 55 lb |

[1)]MLA I & II - Two formulations of Multifunctional Lubricant Additive.
[2)]Product A - A commercially available additive containing chlorinated hydrocarbon.
[3)]Product B - A commercially available additive containing polytetrafluoroethylene.
[4)]600 SNO - 600 solvent neutral oil marketed by Exxon Co. U.S.A.
[5)]Strata XL - A heavy duty 15W-40 gasoline or diesel engine oil marketed by NCH Corporation.
[6)]10W-30 - A popular commercially available multigrade gasoline engine oil.
[7)]Four Ball Wear Test - ASTM D 4172 (40-kg load, 75° C. (167° F.), 60 min.). Smaller the wear scar (in mm), the better.
[8)]FLC Lubricity Test - Tester is marketed by Falex Corporation. Commonly known as "Nutcracker Test". Higher the fail torque (in ftlb), and smaller the wear scar (in mm), the better.
[9)]Cu corrosion Test - ASTM D 130 (100° C. (212° F.), 24 hrs). Lower the rating, the better.
[10)]Fe Corrosion Test - Test condition identical to Cu corrosion test, instead of a Cu strip, a steel (AISI W-1, 1% Carbon) rod is used. After the test the steel rod is rated according to Cincinnati Milacron Inc. Lubricant Heat Test Standards. Lower the rating, the better.
[11)]COF - For Strata XL, coefficient of friction is measured by Falex No. 1 Friction and Wear Test Machine. For 600 SNO and 10W-30 motor oil, coefficient of friction is measured by LVFA test instrument.
[12)]Timken EP Test - ASTM D 2782. Higher the Timken OK value (in lb), the better.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

We claim:

1. A multifunctional lubricant additive comprising from about 2 to about 16 weight percent methylene bis (dibutyidithiocarbamate), from about 2 to about 16 weight percent 2,5-dimercapto-1,3,4-thiadiazole derivative, from about 2 to about 16 weight percent of a tolutriazole compound, from about 2 to about 16 weight percent glycerol monooleate, from about 2 to about 16 weight percent zinc alkyldithiophosphate, from about 0.4 to about 3.2 weight percent calcium sulfonate, from about 0.25 to about 3 weight percent acrylic copolymer, and from about 20 to about 60 weight percent of a polyol ester.

2. The lubricant additive of claim 1 further comprising up to about 0.02 weight percent disazo dye.

3. The lubricant additive of claim 2 wherein the dye is oil red dye.

4. The lubricant additive of claim 1 further comprising up to about 50 weight percent solvent neutral oil.

5. The lubricant additive of claim 4 wherein the solvent neutral oil has a viscosity of about 105 SSU at 100° F.

6. The lubricant additive of claim 1 further comprising up to about 0.6 weight percent alkyl ester copolymer.

7. The lubricant additive of claim 1 wherein the 2,5-dimercapto-1,3,4-thiadiazole derivative further comprises alkyl polycarboxylates.

8. The lubricant additive of claim 1 wherein the tolutriazole compound includes an ester solvent.

9. The lubricant additive of claim 1 wherein the tolutriazole compound includes a petroleum process oil.

10. The lubricant additive of claim 1 wherein the calcium sulfonate has a total base number of about 400.

11. The lubricant additive of claim 1 wherein the zinc alkyldithiophosphate comprises alkyl groups having from 1 to 14 carbon atoms.

12. The lubricant additive of claim 1 wherein the acrylic copolymer is a poly(alkyl methacrylate).

13. The lubricant additive of claim 1 wherein the polyol ester comprises a mixture of pentaerythritol tetraesters and dipentaerythritol hexaesters of $C_5$–$C_9$ fatty acids.

14. A multifunctional lubricant additive comprising about 50 wt. % solvent neutral oil; about 28 wt. % polyol ester; about 4 wt. % each of zinc $C_1$–$C_{14}$ alkyldithiophosphate, a tolutriazole compound in ester solvent, a 2,5-dimercapto-1,3,4-thiadiazole derivative, glycerol monooleate, and methylene bis(dibutyidithiocarbamate); and the remainder of minor effective amounts less than about 1 wt. % each of calcium sulfonate, poly(alkyl methacrylate), a pour point depressant and oil red dye.

15. The lubricant additive of claim 14 wherein the pour point depressant is an alkyl ester copolymer.

16. A multifunctional lubricant additive comprising about 57 wt. % polyol ester; about 8 wt. % each of zinc dialkyl dithiophosphate, a tolutriazole compound in petroleum process oil, a 2,5-dimercapto-1,3,4-thiadiazole derivative, glycerol monoleate, and methylene bis(dibutyidithiocarbamate); minor effective amounts less than about 2 wt. % each of calcium sulfonate and poly(alkyl methacrylate); and a minor effective amount less than about 0.01 wt. % oil red dye.

17. A lubricant containing an additive comprising from about 20 to about 60 wt. % polyol ester, from about 2 to about 16 wt. % zinc $C_1$–$C_{14}$ alkyldithiophosphate, from about 2 to about 16 wt. % tolutriazole compound, from about 2 to about 16 wt. % 2,5-dimercapto-1,3,4-thiadiazole derivative, from about 2 to about 16 wt. % methylene bis(dibutyidithiocarbamate), from about 2 to about 16 wt. % glycerol monooleate, from about 0.4 to about 3.2 wt. % calcium sulfonate, from about 0.25 to about 3 wt. % poly (alkyl methacrylate), from 0 to about 50 wt. % solvent neutral oil, from 0 to about 0.6 wt. % pour point depressant, and from 0 to about 0.02 wt. % dye.

18. The lubricant of claim 17 wherein the lubricant is selected from the group consisting of engine oils, gear oils, hydraulic oils and compressor oils.

19. The lubricant of claim 18 having an additive to lubricant ratio ranging from about 1:15 to about 1:31 by weight.

20. The lubricant of claim 17 wherein the lubricant is a soap-based grease.

21. The lubricant of claim 20 having an additive to lubricant ratio ranging from about 1:7 to about 1:15 by weight.

22. A method for improving the physical properties and service life of a lubricant comprising the step of mixing therewith an additive comprising from about 20 to about 60 wt. % polyol ester, from about 2 to about 16 wt. % zinc $C_1$–$C_{14}$ alkyldithiophosphate, from about 2 to about 16 wt. % tolutriazole compound, from about 2 to about 16 wt. % 2,5-dimercapto-1,3,4-thiadiazole derivative, from about 2 to about 16 wt. % methylene bis(dibutyldithiocarbamate), from about 2 to about 16 wt. % glycerol monooleate, from about 0.4 to about 3.2 wt. % calcium sulfonate, from about 0.25 to about 3 wt. % poly(alkyl methacrylate), from 0 to about 50 wt. % solvent neutral oil, from 0 to about 0.6 wt. % pour point depressant, and from 0 to about 0.02 wt. % dye.

23. The method of claim 22 wherein the lubricant is selected from the group consisting of engine oils, gear oils, hydraulic oils and compressor oils.

24. The method of claim 23 having an additive to lubricant ratio ranging from about 1:15 to about 1:31 by weight.

25. The method of claim 22 wherein the lubricant is a soap-based grease.

26. The method of claim 25 having an additive to lubricant ratio ranging from about 1:7 to about 1:15 by weight.

* * * * *

UNITED STATES PATENT AND TRADEMARK OFFICE

CERTIFICATE OF CORRECTION

PATENT NO : 5,885,942

DATED : March 23, 1999

INVENTOR(S) : Ruiming Zhang et al.

It is certified that error appears in the above-identified patent and that said Letters Patent is hereby corrected as shown below:

Column 2, line 61, change "Vaniube" to –Vanlube—;

Column 3, line 1, change "Vaniube" to –Vanlube—.

Signed and Sealed this

Seventh Day of December, 1999

*Attest:*

Q. TODD DICKINSON

*Attesting Officer*

*Acting Commissioner of Patents and Trademarks*